US005590692A

United States Patent [19]

Dornier et al.

[11] Patent Number: 5,590,692

[45] Date of Patent: Jan. 7, 1997

[54] METHOD FOR AVOIDING FABRIC FAULTS DURING TRANSITIONAL LOOM OPERATING CONDITIONS

[75] Inventors: Peter D. Dornier, Nonnenhorn; Adnan Wahhoud, Lindau; Peter Czura, Wangen; Hans-Dieter Scorl, Lindau, all of Germany

[73] Assignee: Lindauer Dornier Gesellschaft mbH, Lindau, Germany

[21] Appl. No.: 549,624

[22] Filed: Oct. 27, 1995

[30] Foreign Application Priority Data

Oct. 29, 1994 [DE] Germany ..... 44 38 762.8

[51] Int. Cl.[6] ..... D03D 47/30

[52] U.S. Cl. ..... 139/1 R; 139/26

[58] Field of Search ..... 139/25, 26, 116.2, 139/1 R, 110

[56] References Cited

U.S. PATENT DOCUMENTS 4,893,250 1/1990 Sainen ..... 139/1 R
5,246,039 9/1993 Fredriksson ..... 139/1 R
5,335,698 8/1994 Berktold et al. ..... 139/116.2

FOREIGN PATENT DOCUMENTS 0567428 10/1993 European Pat. Off. .
4137681 5/1992 Germany .

*Primary Examiner*—Andy Falik
*Attorney, Agent, or Firm*—W. G. Fasse; W. F. Fasse

[57] ABSTRACT

Faults in fabrics such as smooth woven fabrics or pile fabrics caused by transition operational conditions are avoided, especially on air nozzle weaving looms. Such transition operational conditions may occur when rated operating parameters must be changed, for example, due to the use of a different type of weft thread or a change in the weaving pattern and/or weave binding. For this purpose, the weft thread insertion is interrupted only during the duration of the so-called transition operational conditions. Weft insertion is interrupted by performing so-called fluidic or non-fluidic empty or mis-shots. Simultaneously, the warp let-off and the fabric take-up is controlled as a function of the number or duration of the empty or mis-shots in such a way that at this point of time during the transition operating conditions the beat-up edge of the fabric is held in a position away from the beat-up position of the reed.

12 Claims, 1 Drawing Sheet

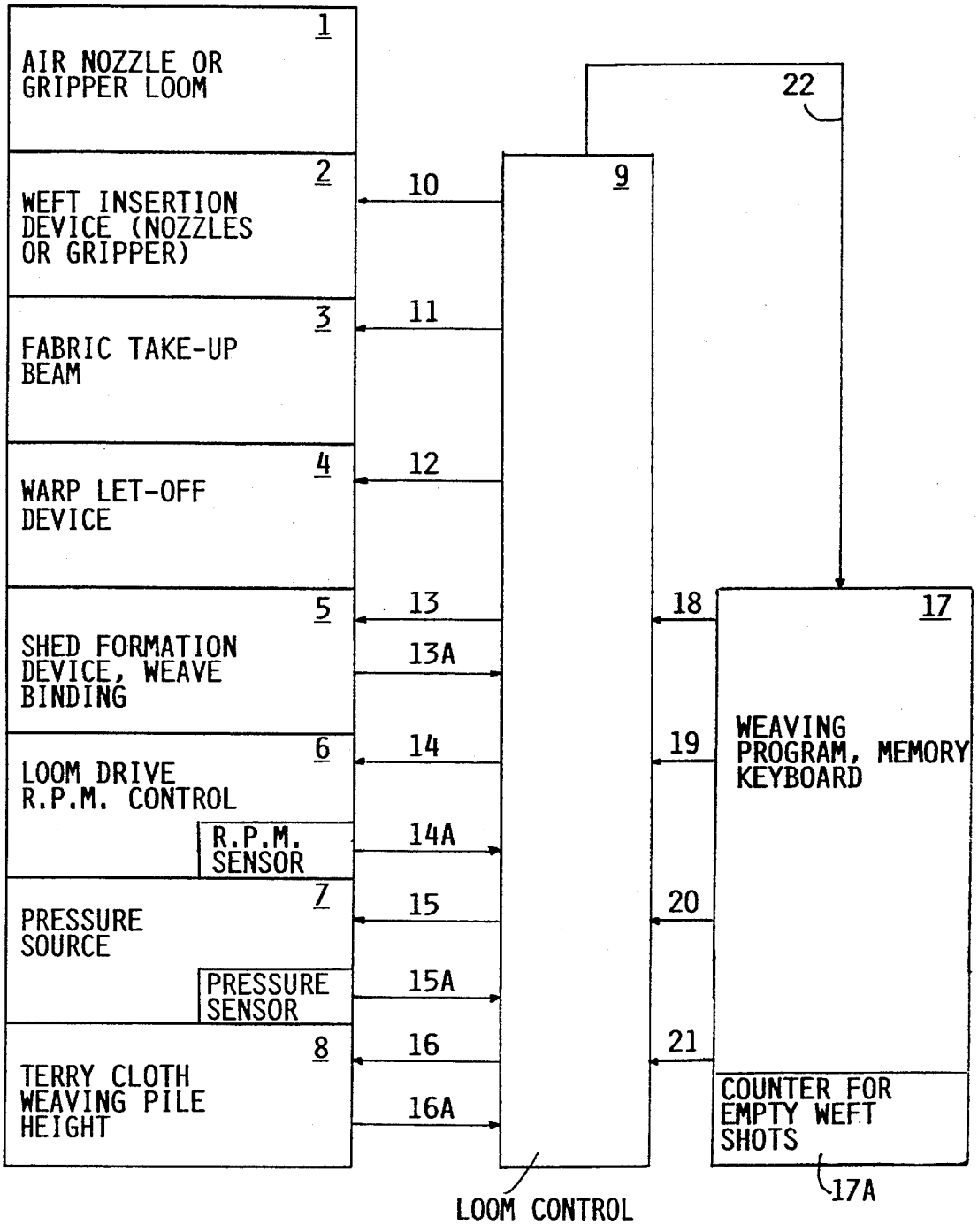
1
AIR NOZZLE OR GRIPPER LOOM
2
WEFT INSERTION DEVICE (NOZZLES OR GRIPPER)
3
FABRIC TAKE-UP BEAM
4
WARP LET-OFF DEVICE
5
SHED FORMATION DEVICE, WEAVE BINDING
6
LOOM DRIVE R.P.M. CONTROL
R.P.M. SENSOR
7
PRESSURE SOURCE
PRESSURE SENSOR
8
TERRY CLOTH WEAVING PILE HEIGHT
10
11
12
13
13A
14
14A
15
15A
16
16A
9
LOOM CONTROL
22
18
19
20
21
17
WEAVING PROGRAM, MEMORY KEYBOARD
COUNTER FOR EMPTY WEFT SHOTS
17A

METHOD FOR AVOIDING FABRIC FAULTS DURING TRANSITIONAL LOOM OPERATING CONDITIONS

FIELD OF THE INVENTION

The invention relates to a method for avoiding faults in smooth fabrics and in pile fabrics. Such faults can be caused, for example by a change in the operating parameters required for example by a changed weft thread while the loom is running.

BACKGROUND INFORMATION

Fabric faults can be caused by so-called transition operating conditions that result from a change in a weaving pattern. A change in a weaving pattern may for example, require a temporary change in the rated r.p.m. of the main loom drive or a temporary change in the rated operational pressure of the auxiliary nozzles that eject air streams for transporting the weft thread through the weft insertion channel of an air weaving loom.

Conventional weaving methods with features for avoiding of weft defects in the fabric assume, that such fabric defects or faults occur when the loom is started, for example, following a standstill. Such standstill may occur due to an interruption of the weaving operation, for example, for the purpose of removing a weft thread break. Reference is made in this connection to German Patent Publication DE-OS 4,137,681 A1 and European Patent Publication EP 0,567,428 A1, the latter corresponding to U.S. Pat. No. 5,335,698 (Berktold et al.).

German Patent Publication (DE-OS) 4,137,681 A1 (Shinbara et al.), published on May 27, 1992 discloses a method and apparatus for preventing of weft defects in an air nozzle loom. The beat-up edge of the fabric is displaced relative to reed beat-up position in the direction of the warp by an automatic control depending on whether the loom drive performs a slow forward or a slow backward rotation.

European Patent Publication EP 0,567,428 A1 (Berktold et al.), published on Oct. 27, 1993 discloses a method for starting a loom and a loom capable of operating in accordance with the method for the purpose of avoiding start-up defects in the fabric due to an improper weft beat-up during starting of the loom either initially or following any other loom stop, e.g. a stop caused by the need for removing a broken weft thread. During a first start-up phase the beat-up edge of the fabric is kept at a spacing from the beat-up position of the reed. At this time the supply of weft thread is blocked, several so-called empty weaving cycles are performed. No shed is being formed at this time. Thereafter, the normal shed forming control is resumed in accordance with the weaving normal program.

Fabric faults in the form of weft defects, however, occur not only during a restarting of the loom following a standstill, but also during normal weaving when changes are made that affect the operational parameters of the loom, for example changing the type of weft thread to be processed. Such operational parameters involve primarily the r.p.m. of the main loom drive and the operational pressure of the auxiliary weft insertion nozzles. These parameters must be automatically changed to avoid conditions that could adversely affect the quality of the fabric, if during such a phase of change a weft thread insertion takes place. Thus, it is known that the weft thread insertion of weft threads of different qualities, for example fiber yarns or chenille yarns, into the loom shed of an air nozzle loom requires different pressure parameters at the auxiliary weft insertion nozzles. Similarly, changes in the loom drive r.p.m. may be necessary in the sense of an r.p.m. reduction or an r.p.m. increase.

It is also known in this connection that during each change of an operating parameter during a weaving operation, short duration so-called transition operational conditions occur. The term "transition operational conditions" is intended to refer to changes occurring during a time duration when the loom control automatically switches, for example, from a first effective rated operational pressure of the auxiliary nozzles to a second such pressure, to a third such pressure, or to a still further effective rated operational pressure. A respective transition parameter becomes effective during the switching. A required change in the r.p.m. of the main loom drive is also to be viewed under this aspect since it causes a respective transition operational condition.

It has been ascertained on the basis of a series of tests that a weft thread insertion that takes place during the duration of a transition operational condition, leads to fabric faults or defects and/or to a stopping of the loom, because between the weft insertion and the other functional operations of the loom there is no synchronism during these transition operational conditions. Thus, there is room for improvement.

OBJECTS OF THE INVENTION

In view of the above it is the aim of the invention to achieve the following objects singly or in combination:

to provide a method for operating an air weaving loom in such a way that a change in operational parameters within a weaving program or variations in a pattern program during the weaving operation will avoid the formation of fabric faults;

to avoid a loom stop in response to program changes or in response to variations in the weaving pattern; and to make sure that no weft thread is being inserted during so-called transition operational conditions.

SUMMARY OF THE INVENTION

According to the invention at least the weft thread insertion is interrupted during each stoppage or changing of the loom shed during a transition time when each change of the operational parameter takes place within a weaving program, whereby the change of the operational parameters takes place depending on the type of weft thread to be woven or depending on a pattern variation causing a change in the type of weave binding and/or the pile height, and wherein during this transition time so-called mis-shots, which may be fluidic or non fluidic, are fired and the warp let-off as well as the fabric take-up device are so controlled depending on the number or the duration of the fired mis-shots that the beat-up edge of the fabric is held in a position spaced from the beat-up position of the reed. The so-called mis-shots do not insert any weft thread, while transition operational conditions prevail. Thus, fabric faults that could be caused by or during these transition operating conditions are avoided.

According to the invention it becomes possible for the first time to make changes in the weaving program during a program sequence and to react in the operation of the loom control to such changes in such a way that fabric faults, for example so-called weft defects or fabric densifications along the beat-up line are avoided. A loom stopping, for example due to the lack of synchronism between the weft thread insertion and the operational parameter such as r.p.m. and operational weft advancing nozzle pressure, is reduced to a minimum. In addition to controlling the pressure of the auxiliary nozzles, the main nozzle pressure may also be controlled. Further, the method according to the invention is also useful for looms which insert the weft thread by devices other than fluid jets, for example by rapier carried weft insertion grippers which would be controlled to cause so-called mis-picks during the transition period when transition operational conditions occur.

BRIEF DESCRIPTION OF THE DRAWINGS

In order that the invention may be clearly understood, it will now be described, by way of example, with reference to the accompanying drawing, wherein the single figure illustrates a block diagram of a loom control operation in accordance with the present method.

DETAILED DESCRIPTION OF A PREFERRED EXAMPLE EMBODIMENT AND OF THE BEST MODE OF THE INVENTION

Referring to the block flow diagram, the loom 1 comprises weft insertion devices 2 which are preferably air nozzles for the weft insertion, such as a main nozzle and a plurality of auxiliary nozzles. However, the invention is also applicable to other weft insertions such as by gripper heads. In both instances weft thread is not inserted into the loom shed during transition operational conditions. The loom further includes a fabric take-up device 3 such as a driven fabric take-up roller, a warp let-off device 4 such as a drive for the warp beam, a shed forming mechanism 5 that changes the position of the warp threads forming the upper and lower shed, a loom drive 6, a compressed air source 7, and if applicable a pile fabric or terrycloth forming device 8. The loom is further equipped with a central loom control 9 connected to the various loom components by electrical conductors 10, 11, 12, 13, 13A, 14, 14A, 15, 15A, 16 and 16A. The central loom control 9 in turn is connected to a program supply device 17 in which the weaving program is stored in a memory and which is also equipped with a keyboard for entry of control information and program information. A closed loop feed-back conductor 22 connects an output of the loom control 9 to the program device 17 which in turn is connected to the loom control through a plurality of conductors 18, 19, 20 and 21.

Control signals for the weft insertion are transmitted on conductor 10. Control signals for the fabric draw-off are transmitted through conductor 11. Control signals for the warp let-off are transmitted through conductor 12. Control signals for the shed formation are transmitted through the conductor 13 and feedback signals from the shed formation are transmitted to the central loom control 9 through the conductor 13A. Similarly, the main loom drive 6 receives its control signal through the conductor 14 and provides through an r.p.m. sensor feedback signals representing the actual r.p.m. of the loom drive to the loom control 9 through the feedback conductor 14A. In an air nozzle loom drive compressed air pressure source 7 is controlled through the conductor 15 and provides through pressure sensors feedback signals representing actual nozzle pressures to the loom control 9 through the feedback conductor 15A. The terrycloth weaving device 8 receives its control signals through the conductor 16 and transmits feedback signals through the conductor 16A to the central loom control 9.

The conductors 18 to 21 provide rated control signals to the central loom control such as a rated r.p.m. control signal, a rated air pressure control signal, and so on. Feedback signals on the feedback conductor 22 provide information, for example regarding the actual r.p.m. of the main loom drive. The actual r.p.m. may be displayed on a display in the program device 17. The feedback signals certify that the respective control signal has been executed as intended, for example with regard to the control of the weft insertion elements, with regard to the program sequence of the weaving program to assure a continuation of the weaving program. For example, the weaving program would be interrupted in response to an improper shed formation feed-back signal.

The sequence of the method according to the invention is as follows. Assume that one type of weft thread is to be replaced by another type of weft thread for the next weaving sequence. The weaving program device 17 will accordingly provide a weft thread change signal to the loom control 9, thereby signifying that other operational parameters must now be employed, such as another rated r.p.m. for the main loom drive and/or another rated operational pressure for the main and/or auxiliary nozzles. These different new operational parameters are always measured or compared to the respective parameters employed just immediately prior to the change. The respective control signal from the control 9 through at least the conductors 14 and 15 to the loom drive control 6 and to the pressure source 7 assure that an r.p.m. change and/or an operational pressure change is executed in the drive 6 and/or in the air pressure supply 7 or in the respective nozzle.

The signals from the control 9 to the respective components in the loom for implementing a change, generate the above mentioned transition operational conditions. During the duration of these transition operational conditions, the weft thread insertion is interrupted according to the invention and the weft thread insertion device 2 merely issues so-called empty or mis-shots. At the beginning of the transition operational conditions the signals on conductors 11 and 12 for the fabric draw-off device 3 and for the warp let-off device 4 are influenced in such a way that the beat-up line of the fabric is held in a position away from the beat-up position of the reed. Thus, it is assured that during the transition operational conditions the reed is not beating-up against the beat-up line of the fabric, whereby an undesired fabric densification along the respective beat-up line is avoided.

Preferably, at the beginning of the transition operational conditions the shed formation device 5 receives through the conductor 13 a signal from the control 9 according to which the heald shafts form a closed shed, whereby the heald shafts are held in a central position and cannot influence the warp tension, whereby the effectiveness of dealing with faults caused by transition operational conditions is enhanced.

Transition operational conditions also occur automatically when, within a weaving program the freely programmable pattern parameters change, such as the type of binding and/or the pile height in a pile fabric. For all these change conditions it is essential that a weft insertion does not take place during transition operational conditions, regardless what the source is for the occurrence of these transition operational conditions. The source may be a change in the weft thread parameters, a change in the binding parameters, a change in the pile height parameters for a terrycloth production, and so forth. Instead of the weft thread insertion, the control during these transition periods is such that fluidic or non-fluidic empty shots are performed which do not insert a weft thread while during these transition periods or phases the functions of the warp let-off and of the fabric take-up merely maintain the required tension in the warp threads and in the fabric.

When the r.p.m. of the main loom drive shaft and the operational pressure of the auxiliary nozzles have assumed the new rated value, the transition operational conditions end. The duration of these transition operational conditions is measured, for example, by counting the above mentioned empty shots in a counter 17A in program device 17. This is possible because the number of empty shots fired per unit of time is known. By controlling the fabric take-up device and the weft let-off device the beat-up edge of the fabric returns into the position which it had prior to the beginning of a transition operational condition.

As the end of a transition operational condition occurs, the normal operational functions of the loom are resumed and maintained until in accordance with the weaving program sequence a new change in the r.p.m. or in the operational pressure of the air supply for the weft insertion nozzles becomes necessary, whereby again the occurrence of a new transition operational condition is treated as described above.

In view of the foregoing it will be appreciated that a transition operational condition occurs, for example, when the fluid pressure of the weft insertion elements, particularly the auxiliary weft insertion nozzles, are changed from one rated pressure value to another rated pressure value, whereby the other rated pressure value may be lower or higher than the one rated pressure value. Similarly, a transition operational condition occurs, for example, when the r.p.m. of the main loom drive is changed from a lower rated r.p.m. to a higher r.p.m. or vice versa. In all instances the respective rated value is provided by the program stored in the memory of the program device 17 and the respective actual value is provided by sensors in the loom.

Although the invention has been described with reference to specific example embodiments, it will be appreciated that it is intended to cover all modifications and equivalents within the scope of the appended claims.

What is claimed is:

1. A method for avoiding weaving defects that can be caused by transition operational conditions in smooth fabrics and in pile fabrics by transition operational conditions occurring during operation of a loom (1) having weft insertion elements (2), a reed (5), warp let-off elements (4), fabric take-up elements (3), and a main loom control (9) including a memory (17) for storing at least one loom control program and an input device for entering control information into said main loom control (9), said control information including rated operational parameters, comprising the following steps:

(a) providing during the operation of said loom a transition signal that signifies the presence and duration of a transition operational condition in the continuous operation of said loom, (b) stopping in response to said transition signal an actual weft thread insertion during said duration of said transition operational condition while simultaneously performing empty weft insertion shots by said weft insertion elements (2) in response to said transition signal, (c) controlling said warp let-off elements and said fabric take-up elements in response to said transition signal in such a way that a beat-up edge of the fabric is held in a position spaced from a beat-up position of said reed during said duration of said transition operational condition, and (d) resuming a normal loom operation at an end of said transition operational condition until a new transition operational condition occurs.

2. The method of claim 1, wherein said controlling step is performed in closed loop fashion.

3. The method of claim 1, wherein said empty weft insertion shots are counted by a counter (17A) to produce a control signal for performing said controlling step.

4. The method of claim 1, wherein said empty weft insertion shots are performed as fluidic weft insertion shots.

5. The method of claim 1, wherein said empty weft insertion shots are performed as non-fluidic shots.

6. The method of claim 1, wherein said transition signal is a signal provided by said at least one loom control program.

7. The method of claim 1, wherein said providing of said transition signal is performed by transmitting to said main loom control a transition start signal from said memory in response to the beginning of a transition operational condition caused by a first rated operational value, detecting the reaching of a second rated operational value signifying an end of said transition operational condition, and producing a transition stop signal in response to said detecting of said second rated operational value signifying the end of said transition operational condition.

8. The method of claim 7, wherein said detecting step to determine the end of said transition operational condition is performed by checking whether the loom operation has reached said second rated operational value.

9. The method of claim 8, wherein said transition stop signal is transmitted to said main loom control (9) as a signal representing a respective programmed main loom drive r.p.m. forming said second operational value.

10. The method of claim 8, wherein said detecting is performed by ascertaining the end of a programmable time count that begins with said transition start signal.

11. The method of claim 1, further comprising causing said transition operational condition by changing a rated fluid pressure for said weft insertion elements (2) from one fluid pressure value to another fluid pressure value.

12. The method of claim 1, further comprising causing said transition operational condition by changing a rated r.p.m. from one r.p.m. value to another r.p.m. value.

* * * * *